United States Patent [19]

Minami

[11] 3,943,940

[45] Mar. 16, 1976

[54] METHOD OF REMOVING NICOTINE IN SMOKING AND A SMOKING FILTER TO BE USED THEREFOR

[76] Inventor: Isao Minami, No. 10-3, Aza-kashikiri, Nakamura, Kitajima, Itano, Tokushima, Japan

[22] Filed: Sept. 13, 1974

[21] Appl. No.: 506,192

[52] U.S. Cl. ..... 131/10.1; 131/261 R

[51] Int. Cl.[2] A24B 15/02; A24B 15/027; A24B 15/04

[58] Field of Search..... 131/10.1, 10 R, 265, 261; 423/265, 274, 593, 599

[56] References Cited

UNITED STATES PATENTS

| | | | |
|---|---|---|---|
| 3,390,686 | 7/1968 | Irby, Jr. et al. | 131/10.1 X |
| 3,434,479 | 3/1969 | Till et al. | 131/265 X |

FOREIGN PATENTS OR APPLICATIONS

| | | | |
|---|---|---|---|
| 1,204,018 | 9/1970 | United Kingdom | 131/10.1 |

*Primary Examiner*—Robert W. Michell
*Assistant Examiner*—V. Millin
*Attorney, Agent, or Firm*—Wenderoth, Lind & Ponack

[57] ABSTRACT

This invention relates to a method of removing nicotine in smoking and a smoking filter to be used therefore. The method according to the present invention comprising the impregnation of smoking filter with an aqueous solution of potassium permanganate and chlorine just before smoking and thereby to change, by the smoking filter through which smoke passes, poisonous nicotine contained in the smoke produced from burning of tobacco into nutritious vitamin which is a factor of vitamin B complex.

6 Claims, 4 Drawing Figures

METHOD OF REMOVING NICOTINE IN SMOKING AND A SMOKING FILTER TO BE USED THEREFOR

In the art of smoking filter, a lot of methods of removing nicotine and smoking filters used for carrying out the methods have been provided conventionally, the methods constituting to remove poisonous substances contained in the smoke produced from burning of tobacco. However, most of the conventional smoking filters are adapted to filtrate only physically the smoke which passes therethrough and remove poisonous substances and they have an inherent defect not to sufficiently remove poisonous substance of nicotine contained in the smoke. A smoking filter is well known in which extremely fine fibers of capillarity and the like having sufficient density are packed in a cylindrical filter case opposite ends of which are opened, in order to filtrate the smoke, however, in this case, the smoking filter filtrates poisonous substances contained in passing smoke only physically so that most of the poisonous substances pass through the smoking filter without removed thereby to affect smokers.

In the meantime, it is known that nicotine is dissolved in water. Another smoking filter taking advantages of this feature is also conventionally known in which the nicotine in the smoke produced from burning of tobacco is removed by dissolving the nicotine in the water. In the smoking filter as above-mentioned, a cigar or a cigarette can be insertable to the top end thereof and a water absorbable member is provided in the inside of a filter case having a longitudinal smoke passing aperture therethrough from the top end to the rear end. However, the smoking filter having the above-mentioned construction cannot remove nicotine so efficiently as to be expected because the nicotine once dissolved in the water contained in the smoking filter is evaporated again in the smoke passing through the smoking filter to be mixed therewith and is inhaled into the human body without removed due to extremely high volatile feature of nicotine even in the room temperature. In other words, in the smoking filter containing water, the amount of removing nicotine is estimated at the difference between dissolution amount and evaporation amount of nicotine, however, the evaporation amount of nicotine is so large that the rate of removing nicotine could not be increased. The more cigarettes are used for a smoking filter to remove nicotine, the more nicotine is dissolved in the smoking filter. This results in reducing dissolution volume of nicotine, but, adversely, the evaporation volume of nicotine which is once dissolved in the smoke increased thus reducing conspicuously nicotine removing effect.

The present invention comprises to impregnate just before smoking an oxidizing liquid of predetermined concentration in a smoking filter having both features of water absorbability and ventilation, in order to oxidize volatile and deadly poisonous nicotine contained in the smoke produced from burning of tobacco. The oxidizing liquid impregnated in the filter can oxidize a sufficient amount of nicotine contained in the smoke effectively in a short time in which smoke passes through the filter. The oxidizing liquid used for the invention is of a kind and a concentration to be harmless to the human body. The oxidizing liquid is adapted to be impregnated in the smoking filter justs before smoking a cigarette in order to minimize a chemical change of the liquid prior to smoking.

By the way, the term "a cigarette" is used throughout the specification for convenience of description, however, it should not exclude other types of tobacco such as a cigar and the like.

Accordingly, the object of the present invention is to provide a method exceedingly efficient in removing nicotine poisonous to the human body which is contained in the smoke from tobacco and is produced in smoking, and a smoking filter to be used for carrying out the method.

The another important object of the present invention is to provide a method of removing nicotine which prevents a chemical change of an oxidizing liquid before using of it and preserves the efficiency of the oxidizing liquid for a long period, and a smoking filter to be used for carrying out the method.

These and other objects, features and advantages of the invention will become apparent from the following description with reference to the accompanying drawing in which.

The invention will be understood more readily by reference to the following examples, however, these examples are intended to illustrate the invention and are not to be construed to limit the scope of the invention.

The present invention is concerned with oxidizing poisonous nicotine produced from burning of tobacco by an oxidizing liquid of a predetermined concentration which is impregnated just before smoking in a smoking filter having both features of water absorbability and ventilation. The oxidizng liquid is selected from those which can oxidize nicotine in the smoke efficiently in an extremely short time below one second in which the smoke from tobacco passes and also are of the kind and the concentration harmless to the human body even if the liquid should be absorbed in the human body. The oxidizing liquid may preferably a water solution of potassium permanganate which could not stimulate skin of the throat and the like even if it is sucked in the mouth nor affects the human body even if it is absorbed in the body. Potassium permanganate is not always harmless to the human body in the case of having thick concentration. On the other hand, however, in the case where the concentration of the liquid is unnecessarily thin, the effect of oxidizing nicotine is reduced. Therefore, in order not to affect the human body even if the liquid is absorbed in the body and also in order to give the liquid an efficiency as to oxidize a desirable amount of nicotine in an extremely short time in which the smoke passes through the filter, the concentration of the liquid may preferably be in the range of 0.05 to 1 percent and more preferably be in the range of 0.2 to 0.5 percent.

Figure 1:
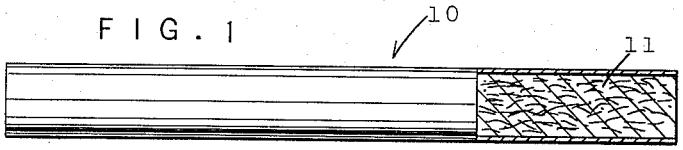
FIG. 1 is a side elevation of a part of a cigarette to which a smoking filter is directly connected to the rear end of the cigarette body according to the present invention.
Figure 2:
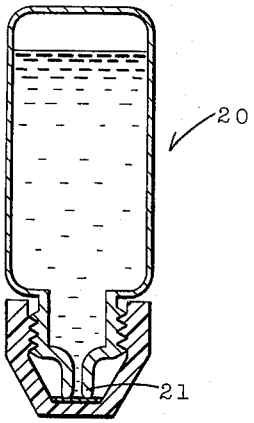
FIG. 2 is a section of a container which contains an oxidizing extract therein.

In the case of FIG. 1 where a smoking filter 10 is constructed in such a manner that it contacts the mouth of a smoker directly, the concentration of the oxidizing liquid should be rather thin within the range as above-mentioned. It is noted that potassium permanganate causes a chemical change if exposed to organic substances or applied with light thereby to weaken oxidizing effect so that a container housing potassium permanganate therein may preferably the one tightly closable and also shieldable against light. The oxidizing liquid is generally impregnated directly by the container to the filter so that a mouth 21 of a container 20 is required to be formed to have a tapered end as shown in FIG. 2. A test in which potassium permanganate solution of 0.1 to 0.4 percent was kept in the container shieldable against light resulted in that the potassium permanganate was dissolved in 1 or 2 months, the color of light pink or purple peculiar to it changed into transparent or red brown and the oxidizing effect of nicotine was conspicously reduced. The test also indicated that dissolution of potassium permanganate is especially rapid in the case of thinner concentration solution of light pink but rather little in the case of thicker concentration solution in the range of 0.4 to 0.5 percent. Even the thicker concentration potassium permanganate solution of 0.4 percent changed from purple to red in 2 or 3 months and to brown in more months resulting in conspicuously reducing oxidizing effect. As the results, it was required that the oxidizing liquid of potassium permanganate solution should be used in 2 or 3 months as longest after it is produced. However, it is extremely difficult that all the products are consumed in a few months after they are produced. Thus, in order to develop a method of stabilizing potassium permanganate solution, a great deal of experiments and studies were followed, which led to an extremely important fact. Potassium permanganate solution is conventionally believed to be more stable as the purity of water flux is higher, however, surprising is that the potassium permanganate dissolved in service water has not been changed in color even after 6 months. The inventor, paying attention to this phenominum, dissolved potassium permanganate of 0.4 percent in the distilled water containing chlorine of 1 ppm, as is the same with water, and found that the potassium permanganate solution did not change in color at all after 6 months as in the case where the potassium permanganate is dissolved in service water. A further experiments of this matter revealed that the chlorine remained in the water may be in the range of 0.05 to 100 ppm if possible and preferably of 0.1 to 1 ppm. Chlorine content is determined at a most suitable value in consideration of concentration of potassium permanganate, the preserved period to be required, construction of smoking filter and the like. According to the experiment of the inventor, potassium permanganate solution of 0.1 percent starts changing the color gradually in about 3 months where chlorine content is 0.5 ppm. Potassium permanganate solution of 0.4 percent does not change the color in three months where chlorine content is 0.1 ppm and does not change the color at all in 6 months where chlorine content is 0.5 ppm. The more the chlorine content, the more stabilized the potassium permanganate becomes. In that connection, it should not be overlooked that a large amount of chlorine content will affect the human body, however, another testing results show that water containing chlorine of 200 ppm is used for drinking without affecting the human body at all and drinking of water containing chlorine of 500 ppm by cats for several months is harmless or it rather adversely fat them. From the results, the preferable limit of chlorine content is up to about 100 ppm. Chlorine content of 100 ppm is larger than that in service water of 1 ppm chlorine content, however, if the fact that the potassium permanganate solution is not drunk as service water is taken in consideration, the amount is not so large as to affect the human body, which is apparent from the above testing results.

In the case where potassium permanganate is impregnated to a smoking filter just before smoking, it is effectively prevented that tobacco would absorb water to deteriorate the taste thereof, which may occur otherwise since much water is contained in the oxidizing liquid impregnated in the smoking filter.

Since the oxidizing liquid is impregnated in the smoking filter just before smoking in this invention as above-mentioned, a part of nicotine contained in the smoke produced from smoking is not only dissolved in the water contained in the smoking filter and is filtrated physically by the smoking filter but also a considerable amount of nicotine is positively changed chemically, by an oxidizing liquid, to an oxide of nicotine which is harmless and unvolatile chemical compound, whereby poisonous nicotine contained in the smoke is extremely efficiently removed.

Nicotinic acid, an oxide of nicotine, is a sticky liquid and hardly volatilized so that it would not be inhaled in the mouth after it is evaporated in the smoke. However, even if it should be, by some reasons, absorbed in the human body, it is harmless at all to the body since the nicotinic acid is a factor of vitamin B complex which is a nutritious vitamin.

All of the nicotine which is oxidized does not change into nicotinic acid, however, it is known that oxides of nicotine are exceedingly weaker in poisonousness than deadly poisonous nicotine or they are mostly harmless.

According to the present invention, nicotine of strong volatilization per se is not separated by physically filtrating or dissolving in the water but is separated after it is changed into a harmless compound in such a manner that it is oxidized positively into the harmless compound so that the nicotine once separated could not be inhaled into the mouth again by volatilizing thereof. Consequently, the present invention can remarkably increase the rate of removing nicotine, which has been difficult in the conventional smoking filters.

One of the experiment results by the inventor shows that in the case where potassium permanganate of 0.4 percent is impregnated as much as possible in the cylindrical smoking filter shown in FIG. 1 which is 8mm in diameter and 20mm in length, the rate of removing nicotine is estimated at a remarkable rate of 50 to 75 percent though there are some values out of the range. However, in the case of the smoking filter in FIG. 1 as stated before, in which the rear end 11 of the smoking filter 10 is holded directly by the mouth, more or less potassium permanganate is unavoidably sucked into the mouth during smoking if a large amount of oxidizing liquid is contained in the smoking filter. Consequently, it is required that the oxidizing liquid to be impregnated in the smoking filter should be reduced. Reducing of the amount of oxidizing liquid to be impregnated naturally results in reducing the rate of removing nicotine, however, experiments show that sufficient smount of nicotine can be removed if only two or three drops of potassium permanganate solution of 0.4 percent are impregnated in the smoking filter. It is difficult to indicate the above matter quantitatively, however, smoking by some people of a cigarette with the smoking filter resulted in that the smoking filter according to the present invention is remarkably mild in taste than the smoking filters in which only water is impregnated and that even if they smoke a lot of cigarettes in a short time they did not have headache, emesis or sick feeling which may occur by heavy smoking.

In the meantime, other poisonous substances contained in the smoke such as tar as well as nicotine are removed in the same manner as the case of nicotine by being oxidized, dissolved or solved thereby to be attached to the sticking nicotinic acid.

Figure 3:
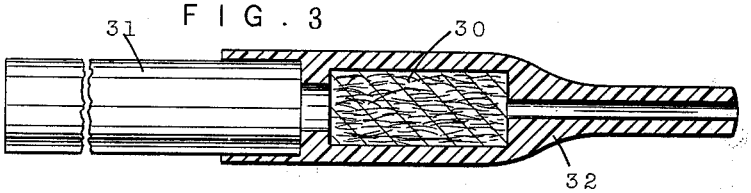
FIG. 3 is a section of another smoking filter to the top end of which is insertable a cigarette.

FIG. 3 shows a smoking filter 30 to which a cigarette 31 is insertable to the top end thereof. If the smoking filter 30 is inserted in a case 32 as in this example, the rear end of the smoking filter 30 does not touch directly with the mouth and so the oxidizing liquid impregnated in the smoking filter 30 on smoking could not be sucked in the mouth. Therefore, more amount of oxidizing liquid can be impregnated in the smoking filter 30. It is required also in this case to impregnate the oxidizing liquid just before smoking in order to prevent degrading of the liquid. Since a cigarette in FIG. 3 is inserted to the smoking filter just before smoking it is possible that the oxidizing liquid of relatively thick concentration which is impregnated just before smoking is diluted by a sufficient amount of water which is previously absorbed in the smoking filter. In this method, the concentration of the oxidizing liquid may, when using potassium permanganate, preferably be in the range of 0.1 to 5 percent. Oxidizing effect of most oxidizing liquids increases in proportion to temperature, as potassium permanganate is no exception, so that it is desirable that more amount of oxidizing liquid is impregnated at the portion of the smoking filter 30 nearer to tobacco.

For this purpose, it is desired to impregnate the oxidizing liquid from the end of the smoking filter to which a cigarette is inserted.

Figure 4:
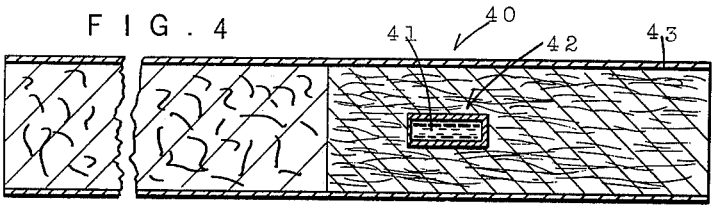
FIG. 4 is a section of another smoking filter which houses a capsule therein.

The smoking filter shown in FIG. 4 has a capsule 42 therein which is filled with an oxidizing liquid 41 of predtermined concentration.

The capsule 42 is formed in such a strength and a shape that it may be easily broken by pinching it and also is made of plastic material and the like which can retain the oxidizing liquid for a long period without degrading thereof. If the capsule 42 filled with the oxidizing liquid 41 is housed previously in the smoking filter, the trouble of dripping the oxidizing liquid into the material of the smoking filter every time of smoking is saved and it is only necessary to pinch a capsule by fingers on smoking in order to facilitate impregnation of the oxidizing liquid into the smoking filter. It is desirable that more amount of oxidizing liquid may be impregnated as far as possible in the high temperature region of the smoking filter 40 adjacent to a cigarette, and so, the capsule may preferably be constructed in such a manner that it is housed in the top end of the smoking filter 40 adjacent to a cigarette or only a portion of it nearer to the cigarette may be broken on pinching the smoking filter 40 by fingers.

What is claimed is:

1. A smoking filter which comprises a filter body and a cigar or cigarette attached thereto which filter is flexible to such an extent that it may deform when pressed by hand, and a capsule being able to be broken when pressed by hand, and filled with an aqueous solution of 0.05 to 1 percent potassium permanganate and chlorine in an amount of 0.05 to 100 ppm, so that when the capsule is broken prior to smoking, the potassium permanganate solution permeates through the filter wherein it is subsequently able to oxidize nicotine contained in smoke passing through said filter.

2. A smoking filter as in claim 1 wherein said capsule is housed in the filter at a position nearest the tobacco in said cigar or cigarette.

3. A method of removing poisonous nicotine by means of a smoking filter attached to a cigar or cigarette which comprises impregnating a smoking filter, just before lighting said cigar or cigarette, with an aqueous solution of 0.05 to 1 percent of potassium permanganate and chlorine in an amount of 0.05 to 100 ppm so as to oxidize, in a short time, the nicotine contained in the smoke passing through said filter as a result of the burning of the cigar or cigarette, said filter being characterized by having good water absorbability and ventillation characteristics.

4. A method according to claim 3 wherein the potassium permanganate solution is directly impregnated in a filter from a container which has a tapered end, said container being constructed of a material which shields the potassium permanganate solution from light, said container also capable of being tightly sealed to prevent decomposition of the potassium permanganate, and constructed so that one end has dimensions suitable for holding a cigar or cigarette and the other end is tapered to be inserted in a smokers mouth.

5. A method of removing poisonous nicotine by means of a smoking filter constructed so that one end has dimensions suitable for holding a cigar or cigarette and the other end is tapered to be inserted in a smokers mouth which comprises impregnating a filter, which has been previously impregnated with water, with an aqueous solution of 0.1 to 5 percent potassium permanganate and chlorine in an amount of 0.05 to 100 ppm, just before lighting said cigar or cigarette, said filter being characterized by having good water absorbability and ventillation characteristics.

6. A method as in claim 5 wherein said oxidizing liquid is impregnated in the end of the smoking filter which is designed to hold the cigar or cigarette.

* * * * *